United States Patent [19]

Weinar

[11] Patent Number: 4,569,172

[45] Date of Patent: Feb. 11, 1986

[54] INTERIOR CORNER CONSTRUCTION FOR WALLBOARD, CEILING AND PARTITION PANEL ASSEMBLIES, AND BACKER CLIPS THEREFOR

[76] Inventor: Roger N. Weinar, 19 Parkside Ave., Hamburg, N.Y. 14075

[21] Appl. No.: 388,757

[22] Filed: Jun. 16, 1982

[51] Int. Cl.[4] ..... E04B 1/38

[52] U.S. Cl. ..... 52/281; 52/714

[58] Field of Search ..... 52/281, 712, 714, 357, 52/358, 361, 362, 363

[56] References Cited

U.S. PATENT DOCUMENTS

| | | | |
|---|---|---|---|
| 1,051,874 | 2/1913 | Ervin | 52/358 |
| 1,998,610 | 4/1935 | Ellis | 52/361 |
| 2,307,898 | 1/1943 | Olsen | 52/358 |
| 2,347,961 | 5/1944 | Olsen | 52/362 |
| 2,390,929 | 12/1945 | Ellis | 52/714 |
| 2,848,758 | 8/1958 | Chisholm | 52/714 |
| 3,210,898 | 10/1965 | Kurtz | 52/281 |
| 3,308,590 | 3/1967 | Ettore et al. | 52/281 |
| 3,881,293 | 5/1975 | Conville | 52/712 |
| 3,962,840 | 6/1976 | Nelsson | 52/281 |
| 4,221,095 | 9/1980 | Weinar | 52/281 |
| 4,296,580 | 10/1981 | Weinar | 52/281 |
| 4,333,286 | 6/1982 | Weinar | 52/281 |

FOREIGN PATENT DOCUMENTS

| | | | |
|---|---|---|---|
| 683119 | 3/1964 | Canada | 52/714 |
| 29364 | of 1913 | United Kingdom | 52/712 |

*Primary Examiner*—Donald G. Kelly
*Assistant Examiner*—Michael Safavi
*Attorney, Agent, or Firm*—Raymond F. Kramer

[57] ABSTRACT

A backer clip, a plurality of which may be used to replace a second framing member normally employed for interior corner constructions of wallboard, ceiling and partition panel assemblies, and suitable for installation on a framing member, is of a continuous length of wire bent to shape so that an interior portion (or exterior portions) thereof is (are) substantially in a single plane, and the corresponding exterior portions (or interior portion) are (is) in a substantially parallel plane when the clip is installed on a framing member, with such interior and exterior portions being connected by legs in a plane at about right angles to such other planes when the clip is installed, and being of such length that sides of the interior and exterior portions facing each other can bear against faces of a substantially rectangular longitudinal framing member onto which the clip may be installed, with the legs along a connecting side of the framing member and with a part of the interior portion or exterior portions of the clip extending beyond the framing member so as to provide a backer for a panel or partition to be assembled adjacent to such framing member. The interior portion of the backer clip is preferably of a squared and/or rounded W shape, and the interior and exterior portions are preferably bent toward each other so as better to grip a framing member, and may be barbed to facilitate more positive gripping. Also within the invention are interior corner constructions wherein a plurality of the described clips are assembled on a framing member, such as a wood 2×4 or a C-shaped metal channel or stud, one panel at a corner has a hidden face thereof against the clips and such panel is maintained in such position by being contacted with the end of an adjacent corner panel fastened to the framing member at a right angle to the first panel. Additionally, the invention includes a tool for applying such clips to framing members, and a method for application of the clips, using such tool.

5 Claims, 11 Drawing Figures

INTERIOR CORNER CONSTRUCTION FOR WALLBOARD, CEILING AND PARTITION PANEL ASSEMBLIES, AND BACKER CLIPS THEREFOR

This invention relates to inside corner constructions, such as those employed for room walls, ceilings and partitions. More particularly it relates to assemblies of panels on framing members, with some of the panels being held in place by novel backer clips, producing the desired inside corners and saving additional framing members that have usually been employed as backers. The invention also relates to the novel backer clips, tools for their installation and methods of installation.

In conventional framed construction, such as that employed for making inside corners of walls, ceilings and partitions, it is a general practice to install additional framing members at each inside corner to provide backing supports for "intersecting" or abutting panels that meet at such inside corners. Because such additional framing members and installation thereof increase both material and labor costs efforts have been made to replace the additional framing members. Metal clips have been provided to support an inside corner panel and obviate the need for extra framing members. However, such clips have required the use of a pointed fastener, such as a nail, screw or prong, which could penetrate the single framing member to secure the clips thereto. For accurate corner construction such clips have to be located precisely, which is difficult to do because common framing members, when made of wood, often have irregular grain patterns and knots, which may prevent location of the fasteners where desired. Also, when the framing member is of metal, holes may have to be drilled in it for screw attachment of the clips, necessitating additional time consuming operations. Such holes also have to be located accurately, which may sometimes be difficult to accomplish easily. Furthermore, such prior art clips for interior room corner construction have normally been of sheet metal which, in the thicknesses available and normally used, if not reinforced, may have backing parts thereof more readily bent than the backing parts of the present invention, and therefore such prior art clips are less useful.

The interior corner construction clips of this invention are effective backers, easily installed in "permanent" relationship with a framing member, and yet, if desired, the clips are removable. In preferred embodiments of the invention the clips are adaptable for installation on framing members of a variety of widths within a given range, such as 2×4's, the widths of which may sometimes vary from 1 5/16 to 1⅝ inches. Additionally, the present clips are manufacturable from readily available material and may be made by machines and methods which are substantially or entirely automatic, lowering the manufacturing cost. The invented clips are light in weight, easy to install by unskilled workers, readily visible for inspection prior to final panel board assembly, and of good fire ratings. Because the panel board bears against the backing portions of the clips without being held to such backers by a positive fastener, such as a nail or a screw, "poppings" of nails after installation are avoided.

In accordance with the invention a backer clip, useful for interior corner constructions of wallboard, ceiling and partition panel assemblies when installed on a framing member, comprises a continuous length of metal wire bent to shape so that an interior portion or exterior portions thereof is/are substantially in a single plane and the corresponding exterior portions or interior portion are/is substantially in a parallel plane, when the clip is installed on a framing member, with such interior and exterior portions being connected by substantially coplanar legs of such length that sides of such interior and exterior portions facing each other can bear against faces of a framing member of substantially rectangular cross-section onto which the clip may be installed, with the legs along a connecting side of the framing member and with a part of the interior or exterior portion(s) of the clip extending beyond the framing member so as to provide a backer for a panel to be assembled adjacent to such framing member.

In a preferred embodiment of the invention the clip is of spring steel, the interior portion is shaped like a squared and/or rounded W, with the central part thereof projecting beyond the plane of the connecting legs by a distance about 20 to 200% of that from the bottoms of the W to the plane of said legs, the exterior portions of the clip extending from the connecting legs substantially in the direction in which the central part of the W extends, and the connecting legs extending substantially at right angles to the planes of the interior and exterior portions of the clip, when the clip is installed on a framing member of rectangular cross-section. The invention also includes interior corner constructions, of which such clips are parts, a tool which may be advantageously employed for installing such clips, and a method for their installation.

A preliminary novelty search in the classified patent files of the U.S. Patent and Trademark Office resulted in the finding of the following U.S. Pat. Nos.: 647,705; 1,057,431; 1,078,273; 1,201,820; 1,656,400; 1,879,778; 1,913,527; 1,947,239; 1,962,452; 2,216,019; 2,307,899; 2,347,961; 2,390,929; 2,668,342; 2,697,262; 2,825,949; 2,909,821; 3,004,369; 3,038,572; 3,142,938; 3,280,771; 3,370,557; 3,471,988; 3,499,257; 3,630,554; and 4,117,642.

Of the above patents it appears that the more relevant are U.S. Pat. Nos. 1,078,273; 2,307,899; 2,347,961; and 4,117,642. Of these, the most relevant appears to be U.S. Pat. No. 2,347,961 (Olsen). The Olsen patent discloses a bent wire clip for securing lath to studding, and the interior portion of the Olsen clip may be considered to resemble a rounded W. However, the patented clip is intended to have the ends thereof hammered into a stud and they are inappropriate for gripping the face of a stud without being hammered into it (unlike the clips of the present invention). Furthermore, the Olsen clips are intended for securing the lath to the studding to form a continuous wall. They would not be useful for making interior corners nor for backing panel boards at such corners.

The only other possibly relevant prior art that has come to the attention of the present inventor is an illustration of what appears to be a wire bent into a double hook-and-eye structure, shown in the 1981 edition of Thomas Register, under the heading Wire Forms.

The invention will be readily understood by reference to this specification, including the following description, taken in conjunction with the drawing in which.

Figure 1:
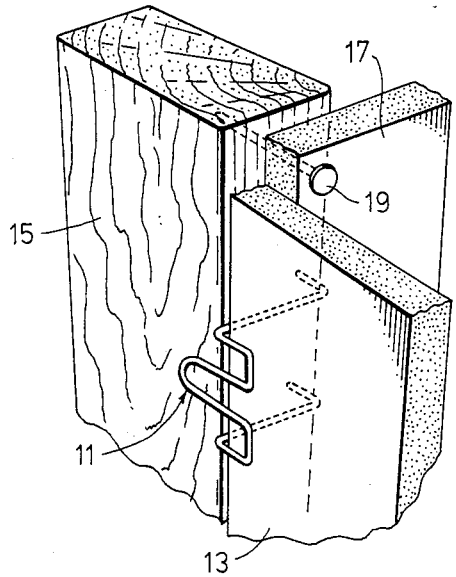
FIG. 1 is a fragmentary perspective view of an improved corner construction of this invention, in which a backer clip of the invention is shown, against which a typical wallboard panel is held in position to form the improved corner.

Referring now to FIG. 1 of the drawing, in which a preferred form of improved inside corner construction is illustrated, backer clip 11, installed on a common wood stud framing member 15, supports or backs wallboard panel 13, which panel is held in place by "intersecting" or abutting wallboard panel 17, correspondingly held to stud 15 by a plurality of suitable penetrating positive fasteners, such as nail 19, hammered into a side of the framing member 15.

In a typical construction, wood stud framing members are employed, such as the common "2×4", the nominal dimensions of which are 1½ inches (3.8 cm.) by 3½ inches (8.9 cm.) by 7 or 8 feet (2.13 or 2.44 meters). The wallboard, ceiling or partition panel will ordinarily be a "drywall" or paper wrapped gypsum sheet having a thickness in the range of ¼ inch (0.64 cm.) to one inch (2.54 cm.).

Operative backer clips of the invention, such as that illustrated in FIG. 1, can be formed of any of a variety of materials, including various metals and some suitable plastics and can be made by various processes, including automatic and semi-automatic wire forming and bending techniques, hand bending and shaping, and molding (primarily in the case of plastics). Desirably, backer clips will be of metal, preferably steel, and will possess at least some "springiness" so that when they are subjected to a distorting force they will tend to return at least partially to initial clip shape. Various grades of spring steel and other springy metals and alloys may be utilized, preferably with a carbon content of at least 0.2% and more preferably with such content being 0.3% or more for steel. It is preferred for reasons of economy and product characteristics to utilize common "coat hanger" grade steel wire which is tempered (basic hard). Such wire is preferably No. 13, standard wire gauge, with a diameter of 0.92 inch (2.34 mm.) but useful clips of the type of this invention have been made from wires of diameters in the range of 0.016 inch (0.41 mm.) to 0.183 inch (4.65 mm.). Preferably, the wire thickness will be in the range of 0.05 inch (1.27 mm.) to 0.14 inch (3.6 mm.). The wire is preferably round but wires of other suitable cross-sections, e.g., square, rectangular, flat rectangular, elliptical, may also be employed. The invented clips may be subjected to heat treatment after forming (for hardening or increasing springiness) or alternatively, in many cases the wire may be so treated before the clips are made.

Referring again to FIG. 1, it should be noted that only one wallboard panel 17, of the two is secured to framing member 15 by positive mechanical fastening means, such as nail 19 or other holding means (a screw, drive screw or other suitable fastener). Because it is not positively held to the corner framing member 15 the "free" or unfastened panel 13, which is put into place after installations of a plurality of desirably (usually evenly) spaced clips 11 along the length of framing member 15, and before panel 17, is able to "float" or adjust to minor framing member movements, such as may occur after completion of the wall, often minimizing the possibility of cracks forming in the finished joint. The final inside joint or corner may typically be covered with a ribbon of paper tape embedded in several layers of gypsum compound (applied wet), not shown. The construction illustrated in FIG. 1 is of a vertically oriented interior corner such as occurs at intersecting or abutting wallboard panels but such construction is also applicable to interior corners between ceiling and wall panels and to interior partition joints.

Figure 2:
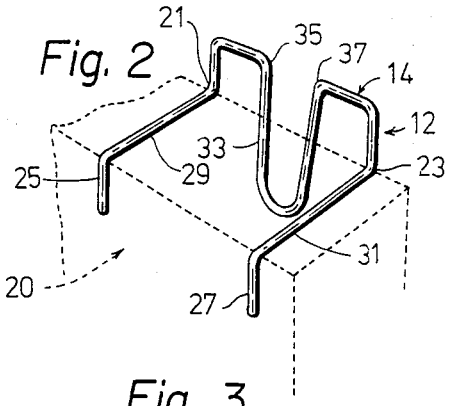
FIG. 2 is a perspective view of a wire backer spring clip like that shown in FIG. 1, installed on a framing member, part of which is indicated by phantom lines.

In FIG. 2 a clip 12, like the wire backer clip 11 of FIG. 1, is shown in more detail, installed on a phantom framing member 20, like that of FIG. 1 but oriented horizontally so as better to illustrate the invented clip. Backer clip 12 is of a continuous length of metal wire bent to the desired shape so that an interior portion of the wire 14, from corner 21 to corner 23, is substantially in a single plane, as shown, when the clip is installed on a framing member, and corresponding exterior portions 25 and 27 are substantially in a parallel plane, also when the clip is installed on a framing member. Connecting substantially coplanar legs 29 and 31 are of such length that sides (not specifically numerically designated) of such interior and exterior portions facing each other can bear against faces of framing member 20 (which framing members are of substantially rectangular cross-section) onto which the clip may be installed, as is shown. As illustrated, interior portion 14 of clip 12 is shaped like a squared and rounded W (inverted) with the central part 33 thereof, between rounded corners 35 and 37, projecting out beyond the plane of the connecting legs (and the plane of the connecting side of the framing member) by a distance of about half the maximum "height" of the inverted W, and bearing against what will be termed a first face of the framing member. As is seen from FIG. 2, connecting legs 29 and 31 extend substantially at right angles to the planes of the interior and exterior portions of the clip (and to the connected parts thereof) when the clip is installed on a framing member of rectangular cross-section.

Figure 3:
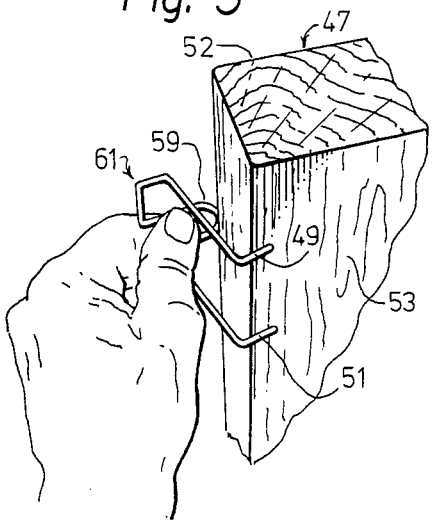
FIG. 3 is a partial pictorial perspective view showing a backer spring clip like those of FIG'S. 1 and 2 being installed on a typical framing member (a wooden stud)

In FIG. 3 is shown how a backer clip of this invention may be installed on a common stud framing member 47 without tools or nails or other positive holding means. The external or exterior clip portions or ends 49 and 51 are first urged against second stud face 53 of framing member 47 and thumb pressure then causes the central W part 59 of clip 61 to clear the first face 52 (hidden) of framing member 47, after which the clip is slid into desired final position, like that shown in FIG. 1. As thumb pressure is relaxed the opposing interior and exterior parts of the clip press against and grip opposite sides of the framing member. The gripping power of the invented backing device may be increased by modifications of surfaces of the clip that contact the framing member faces, as illustrated in FIG'S. 4 and 7.

Figure 4:
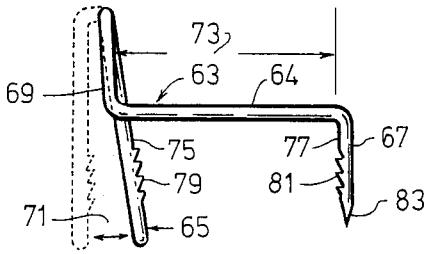
FIG. 4 is a side elevational view of a backer clip similar to those of FIG'S. 1–3, but including modifications of portions thereof, illustrating (in phantom) deflection of a part of the clip on installation.

In FIG. 4, where backer clip 63 is shown in a relaxed (uninstalled) position, central part 65 of the W is canted inwardly toward opposing exterior clip portion 67 (only one of such portions being visible) to increase installed tension. The ability of part 65 to deflect, as outlined in phantom, beyond external parts (or shoulders) 69 of the W, against which the "floating" wallboard panel bears, permits the backer spring to adjust over an angle, illustrated at 71, to normal variations in framing member thicknesses (and such thicknesses can be different over the length of the wallboard) without affecting dimension 73, which is maintained constant, thereby helping to align the backers better when the second face of the framing member, against which the exterior parts 67 of the clip press, is the truer face (and such condition will usually be maintained). Note that clip parts 69, usually at right angles to legs 64 (only one which is visible) maintain that relationship and do not bend when the central part 65 of the clip interior portion is opened (or closed) during installation of the clip. As shown in FIG. 4, the surfaces of the interior and exterior portions of the wire clip facing each other, 75 and 77, respectively, are barbed at 79 and 81 respectively, or are otherwise distorted or modified to increase the gripping power of the clip and better enable it to be tightly held to the faces of the framing member. Although barbs are preferred, with the inclination thereof being as illustrated at 79 and 81, to facilitate clip installation and oppose removal, other means may also be employed to modify the clip surfaces mechanically, chemically or electrically, usually by scoring or roughening the appropriate surfaces to increase friction. Alternatively, the surfaces may be coated with a frictional material, such as rubber, plastic, or abrasive. The rubber may be applied to the clip as a latex and may subsequently be cured (or may remain uncured) or rubber or plastic tubing sections may be used to cover appropriate portions of the clip. Abrasive particles or other frictional particulate materials may be cemented or partially fused onto such appropriate portions of the clip. In FIG. 4 the ends 83 (only one is visible) are pointed to facilitate installation on a framing member like that shown in FIG. 5.

Figure 5:
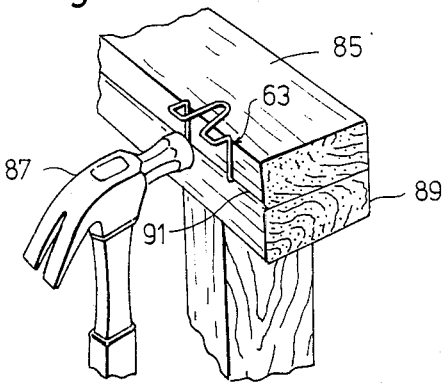
FIG. 5 is a partial pictorial perspective view illustrating hammer installation of a backer spring of this invention on common double plate framing members.

In FIG. 5 there is illustrated the driving of a clip 63 into position holding onto framing member 85 with clip ends 83 being driven by hammer 87 between contacting faces (not identified) of framing members 85 and 89 (both of which combine to form a common double plate) along contact plane 91. Although it is not necessary, to facilitate entry of the clip ends between the double plate framing members the exterior portions of the clip may be flattened. The flattened clip will still preferably be barbed and it and the unflattened clip may be barbed on both sides of the exterior portions thereof.

It was previously indicated that the backer clips of the present invention, although they hold tightly to a framing member, are comparatively easily removable therefrom when such removal is desired. Thus, for example, considering the assembly illustrated in FIG. 1 to be subjected to such a disassembly operation, after removal of panels 17 and 13 clip 11 may readily be removed from the framing member by exerting hand pressure against the "bottom" portions of the W in the direction of the clip ends, so that the ends, even if equipped with barbs, will be disengaged from the corresponding framing member face against which they had been pressing. Then a knife blade or similar tool part is inserted between the framing member face and the clip ends and is moved parallel to the framing member to disengage the clip ends, so that the backer clip springs loose, which it will do even when the inner part of the W is barbed. When demountable walls, ceilings or partitions are installed, fasteners, such as the nail shown at 19 in FIG. 1, may be replaced by demountable corner clips, which can positively hold the second corner panel to the framing member, while still keeping it readily removable without damage to the panel. Because the clip ends cannot be moved away from the face of framing member 85 by pressure on the corresponding parts of clip 63 when the clip is installed on a framing member which is a part of a double plate (as shown in FIG. 5), it is recommended that such a clip be removed by inserting a hammer claw between the side of the framing member and a connecting clip leg, near the clip end, and turning the hammer to pull such end loose, after which the operation may be repeated for the other end, and the clip will spring free. Instead of a hammer claw, a pair of pliers or other suitable gripping tool may be employed to pull the connecting legs of the backer clip, near the ends thereof, away from the side of the framing member, one after the other.

Figure 6:
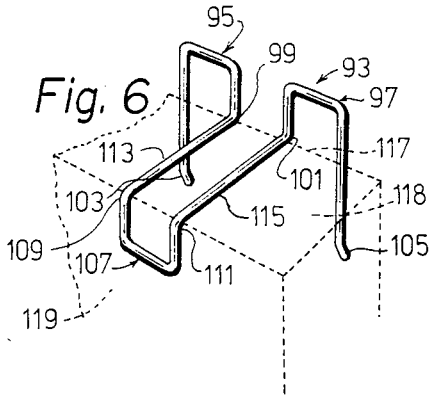
FIG. 6 is a perspective view of another embodiment of a wire backer spring clip of this invention, installed on a framing member, part of which is indicated by phantom lines.

FIG. 6 illlustrates another embodiment of the present invention which, although not as commercially and functionally attractive as the preferred embodiment previously described, is operable in the same general manner. The primary difference in construction, as will be evident from a comparative study of FIG'S. 6 and 2, is that the exterior portions of the clip of FIG. 6, which portions are between the connecting legs and the clip ends, include the backing parts of the clip, whereas the clip shown in FIG. 2 has such backing parts in the interior portion of the clip. Of course, there are corresponding changes in the positions of the parts of the clips which hold to the second face of the framing member (that away from the face of which the backer parts of the clip are extensions). Still, the second type of clip and modifications of both clips which will be apparent to one of skill in the art, such as those clips resulting when the articles of FIG'S. 2 and 6 are changed in structures by having the ends thereof connected and by being separated at the (present) wire midpoints, are operative and are within the broader area of this invention. In FIG. 6 wallboard backer spring clip 93 has exterior portions thereof 95 and 97, extending from rounded corners 99 and 101 to the ends of such clips, 103 and 105, respectively, an interior portion 107 bounded by rounded corners 109 and 111, and connecting legs 113 and 115. The exterior portions are in a plane along a first surface 117 of a framing member, when installed, and extending beyond it. Such extensions serve as backers for a first wallboard panel to be installed. The interior portion extends in a plane along a second face 119 of the framing member and the connecting legs extend along a framing member side 118 connecting the two faces, when the clip is installed. In the version of this clip illustrated, ends 103 and 105 are angled outwardly (away from the plane of the exterior portion of the clip) to provide lead-ins to facilitate installation of the clip on the framing member. Of course, such lead-ins may be omitted and the illustrated clip may be barbed in the appropriate places. Also the "outer" parts of the exterior portions (and the interior portion too, if desired) may be angled so as better to hold onto framing members of different dimensions (although the clips will normally be made so as best to fit a framing member of particular measurements).

It has been found that when there are comparatively great variations in the thickness of the framing members for which the clips are designed, clips of the type illustrated in FIG. 6 may be especially beneficial because of the greater variation possible in movements of the external parts of the exterior clip portions to accommodate such variable framing members. Still, although such external parts may move to accommodate variations in the framing member thickness, the backing portions of the clip intended to contact the panel to be installed do not move, and the same advantage in this respect is obtainable as has previously been described for the type of clip illustrated in FIG'S. 1–5. When a clip of the type of FIG. 6 is assembled onto a framing member which is part of a common double plate of the type illustrated in FIG. 5, it is preferred to flatten and/or point the interior to facilitate entry between the individual framing members of the double plate. However, it is also preferred to maintain barbings on such flattened portion, sometimes preferably on both sides thereof, so that even if the barbs are shallower they will hold effectively to both framing members of the double plate.

Figure 7:
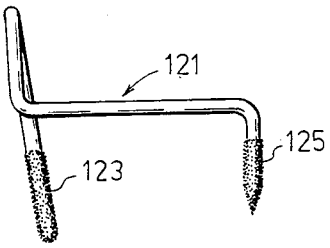
FIG. 7 is a side elevational view of a backer clip of this invention, illustrating surface treatments of parts thereof to help prevent movement of the clip once it is installed on a framing member.

In FIG. 7 there is shown a wallboard backer spring clip 121 like clip 12 of FIG. 2 but with central and end portions thereof having abrasive or other highly frictional surface coatings 123 and 125 thereon, of a type previously described. Such coatings improve the gripping and holding power of the clip on a framing member.

Figure 8:
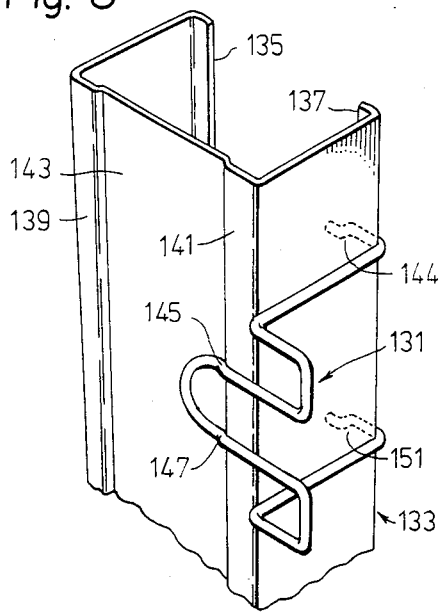
FIG. 8 is a perspective view of a modified backer clip of this invention, installed on a metal C-channel type stud framing member.

FIG. 8 is an illustration of a modified wallboard backer clip 131 of a construction similar to clip 11 of FIG. 1 and clip 12 of FIG. 2 but adapted for fitting onto a common metal stud framing member 133 of the C- or "channel" type, onto which it has been installed, as illustrated. Channel shaped stud 133 has ends 135 and 137, and strengthening corner ribs 139 and 141, which ribs are connected by a depressed face 143. Although barbs and other frictional surfaces on clip 131 will help to hold it in place on metal stud 133, just as others of the previously described clips may be held to wooden or synthetic organic polymeric plastic studs, into which they may bite or against which they may press, and although clip 131 may have one or more of the interior and exterior portions thereof bent (toward each other) to increase the gripping force, it is also highly preferable that clip 131 be bent at inner part locations 145 and 147 to fit about rib 141 and contact depressed face 143. Similarly, the ends of such clip may be bent at 144 and 151 to fit around the channel end 137. Of course, such bendings will similarly accommodate rib 139 and end 135 when the clip is so installed. Other clips of this invention may also be held to metal studs. For example, the clip illustrated in FIG. 6 may be modified for metal channel installation by effecting similar bends in the appropriate portions thereof.

Figure 11:
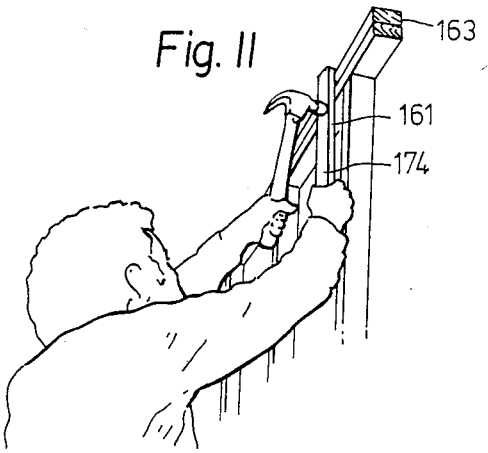
FIG. 11 is a partial pictorial perspective view illustrating installation of a backer spring of this invention on common double plate framing members by means of an installation tool of this invention.
Figure 9:
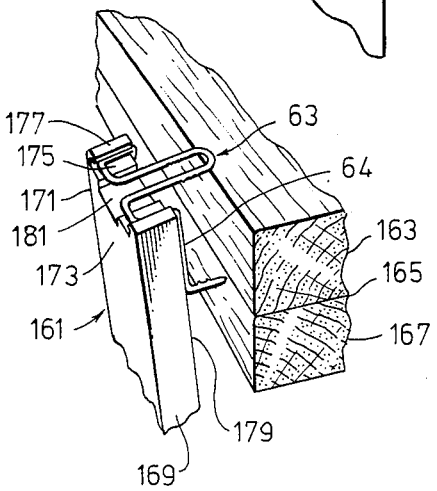
FIG. 9 is a partial perspective view of a tool of this invention holding a backer clip of this invention in position for installation on common double plate framing members, such as are useful for ceiling construction.

The tool 161 of FIG. 9 is shown holding clip 63 while such clip is about to be installed on framing member 163, which is joined along plane 165 to framing member 167 to form a common double plate, of the type often employed atop wall studs and for ceiling installation. Installation of clip 63 on framing member 163 is essentially the same as illustrated in FIG. 5 with the exception that the described tool is employed to hold the clip and position it during its application. As is seen in FIG. 9, tool 161 comprises a body 169 of form retaining material, such as wood or wood covered with reinforcing metal at appropriate locations, a clip holding portion 171 and a striking or force transmitting portion 173. Handle part 174 is not shown in FIG. 9 but does appear in FIG. 11. Holding portion 171 of the substantially longitudinally extending tool is at or near an end of the tool body and includes a channel 175 extending transversely with respect to the longitudinal axis of the tool. In such channel, which preferably includes partial covering ends, like that illustrated at 177, the clip is held, with clip legs 64 against a force transmitting face 179 of the tool. As shown in FIG. 11, the tool 161, with the clip appropriately positioned and held therein, is raised to a position such that the clip interior and exterior parts "embrace" framing member 163 and then the tool is struck at its force transmitting portion, preferably about mid-way between the framing member faces (or as high as the installer can reach) with a hammer, so that the hammering force is transmitted to the clip along the legs 64 thereof and the clip is then firmly positioned. The tool may then be withdrawn so that another clip may be inserted therein and the operation may be repeated.

Figure 10:
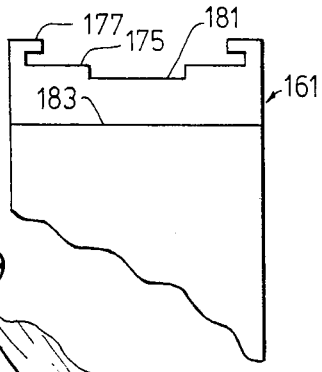
FIG. 10 is a partial front elevational view of the tool shown in FIG. 9, illustrating the construction of the end thereof.

FIG. 10 shows details of tool 161, previously described, including centrally located narrower lower channel 181. The lower channel accommodates the bent "down" internal part of the interior portion of the clip and in some instances may better accommodate other types of clips. Line 183 is an aim line for most effective application of the installing force and shows where the hammer head is desirably struck.

While the preceding description, taken together with the drawing, will make the basic aspects of the invention apparent to one of skill in the art reading this specification, it is considered that additional descriptions of preferred embodiments and variations of the invention, plus recitations of various advantages thereof are warranted. It is highly preferred to employ a continuous wire for the present clips but the broader scope of the present invention is not thought to be avoidable by substituting a discontinuous wire or other thin longitudinally extending or filamentary material having springy characteristics, which is joined or connected in some non-critical location(s). Also, employment of sheet metal parts which resemble flattened wire structures can be within the invention. The preferred squared and/or rounded W, may include such a W with all parts thereof squared, with corners rounded to avoid undue strain, or may include all rounded parts, or mixtures thereof. While the structure illustrated in FIG'S. 1–5 is most preferred, the four similarly extending parts of the W need not be parallel to each other, and can be angled like a conventional letter W (with the central section extending to produce a backer portion), with the corners being appropriately rounded. The central part of the W can project beyond the plane of the connecting legs by a distance about 20 to 200% of that from the bottoms of the W to the plane of said legs, with such extension preferably being from 50 to 150% and most preferably about 100%, as illustrated. When the interior and exterior portions of the invented clip are of squared and/or rounded U and J shapes, respectively, with the interior U portions and the exterior J portions being in planes located substantially parallel to each other when the clip is installed on a framing member of rectangular cross-section, and with U-shaped portions of the J's being suitable for use as backers for a panel to be assembled adjacent to a framing member onto which the clip is installed, as in FIG. 6, the extension of the backing portions can be within the 20 to 200% range, etc., compared to the extension of the gripping outer portions of such clips. As with the W-shaped clips the connecting legs will preferably be at right angles to the exterior and interior portions to which they are joined but such angles may be varied without departing from the broader area of the invention.

Various types of clips within this invention may have the interior and/or exterior portions thereof bent toward each other, with such bending angles usually being within the range of 5° to 25° from the normal, preferably 5° to 15°, e.g., about 10°. Clip ends may be pointed when appropriate and such points may be of any of various suitable types, including blunted points for greater safety in handling. Similarly, the scorings or barbings of clip parts may be of various types but normally the barbs will be of such structures as to prevent unintended withdrawal of the clip after installation. In some cases the barbs may be of such a structure as to prevent lateral clip movement too. When the clip is of W shape, with the middle part thereof extended, such extension will usually be from 10 to 100% farther along a framing member, when the clip is installed, than the extension of the exterior clip portions along such framing member. Preferably such percentage will be from 10 to 50% or 20 to 40% or 50%, e.g., about 30%. Similar percentage extensions may apply for clips of other designs, comparing parts holding to the framing member, but such percentages may be varied depending on the particular applications for the clips and the clip structures. The above descriptions of variations are of several different clips (and corner constructions) within the present invention but it will be evident that other such constructions are also within the invention.

The present backer clips, also sometimes referred to as to backer springs, possess many advantages over conventional double studding for corner construction, several of which advantages have been previously mentioned. Primarily, in a typical house it is calculated that on the average about $300.00 will be saved, considering the present costs of wood and clips, by substituting clips for one-half of normal double members, employing only single framing members at corners. Thus, with from 5 to 9 clips replacing an eight foot length of studding, on the average savings of $1.00 to $2.00 or more can be made. Similarly, because the present clips are less expensive, significant savings can be made over the initial costs of other corner clips. Furthermore, other clips often require more expensive installation and the use of special tools whereas the present clips are often installable by hand or with only simple and inexpensive tools. Of course, in addition to material savings there are significant labor savings with respect to both conventional studding and other backer clips. For example, some competitive clips have to be joined to framing members and panels by dry wall applicators ("rockers") during panel installation whereas the present clips may be installed by any apprentice or helper. Nailed or prong clips can easily be misaligned and may cause the setting of common warps or bows in the framing members when the clips are nailed in place. Additionally, various sizes of such clips may be required for different board thicknesses, increasing the inventory of clips that must be kept on hand. On the contrary, the present springs are self-aligning and they grip (not puncture) the studs. Therefore, they don't drift or become misaligned when the studs are of heavy grains or are knotted. While some parts of the present clips are flexible, the backing parts are rigid and perfectly located, guaranteeing straight corners. Furthermore pressure by a panel against the backing part of the clip does not cause the clip to be released from the framing member and can actually improve such gripping. The present spring backers can be installed long before the wallboard is to be assembled. Thus, any missing backers are easily noted on inspection and may be replaced at any time. Other backer clips, installed by dry wall applicators, may be covered immediately and accordingly, the fact that clips are missing is not discoverable by inspection unless the inspector is present all the time when the panels are being installed. The present clips produce a true floating corner which effectively reduces cracking and nail poppings resulting from stresses at intersecting panels. Backer clips have been found to be in accordance with various model codes (BOCA, ICBO and SBCCI) and it is considered that the present clips and walls made with them are of satisfactory fire ratings. Such clips help to reduce energy costs by eliminating uninsulated stud boxes at corners and partition intersections, thereby cutting heating and air conditioning energy losses.

In summary, the present clips are economical, are installable easily and conveniently by unskilled workmen, and produce a better interior corner, when compared to other backer clips and to conventional double membered interior corners.

The invention has been described with respect to various embodiments and illustrations thereof but it is not to be limited to these because it is evident that one of skill in the art will be able to utilize substitutes and equivalents without departing from the invention.

What is claimed is:

1. An interior corner construction of wallboard, ceiling, or partition panels meeting side to face at a framing member which comprises an elongated framing member of substantially rectangular cross-sectional shape, a plurality of panel backer clips having backing portions and means for fastening to framing members, which clips are held to opposed first and second faces of such a framing member, with intermediate portions along an intermediate side of the framing member, in the same relative orientation with respect to it and at a plurality of locations along the length thereof, a first panel having a side thereof abutting the intermediate portions of the backer clips and substantially abutting the intermediate side of the framing member and with a hidden face thereof against backing portions of the clips, which serve as extensions of the first face of the framing member, and a second panel having a side thereof positioned against the "exposed" face of the first wallboard, with a hidden face of the second panel near such side thereof against the intermediate portions of the clips and substantially against the intermediate side of the framing member, and with the second panel fastened by positive fastening means to the intermediate side of the framing member, with the backer clips being of individual continuous lengths of wire bent to shape so that an interior portion or exterior portions thereof fit(s) against the first face of the framing member and extend(s) beyond it to provide a backer for the hidden face of the first panel, the remaining exterior portions or interior portion of the wire hold(s) to the second face of the framing member and the exterior and interior parts of the wire are connected by intermediate coplanar legs extending along the intermediate side of the framing member.

2. An interior corner construction of wallboard panels according to claim 1 wherein the clips are of spring steel, have interior portions shaped like a squared and/or rounded W, with the central part thereof projecting beyond the connecting legs by a distance about 20 to 200% of that from the bottoms of the W to the plane of said legs, the exterior portions of the clips extending from the connecting legs subsantially in the direction in which the central part of the W extends, and the connecting legs extending substantially at right angles to the planes of the interior and exterior portions of the clip, when the clip is installed on the framing member.

3. A corner construction according to claim 2 wherein the clip ends and sides of the central part of the W are barbed on faces thereof facing each other so as to facilitate gripping of a framing member.

4. A corner construction according to claim 2 wherein the inner part of the W portion of the clip is bent toward the plane of the exterior portions of the clip to facilitate positive gripping of a suitably sized framing member by the installed clip and to inhibit release of the clip from the framing member.

5. A corner construction according to claim 2 wherein the clip ends and sides of the central part of the W are bent toward each other so as to conform to rigidifying ends and shoulders, respectively, of conventional C-shaped metal channel studs or framing members and to promote positive gripping of such framing members by the clip.

* * * * *